US010362923B2

(12) United States Patent
Thiyagarajan

(10) Patent No.: US 10,362,923 B2
(45) Date of Patent: Jul. 30, 2019

(54) VALVE FOR A SPRAY ARM OF A DISHWASHER APPLIANCE

(71) Applicant: Haier US Appliance Solutions, Inc., Wilmington, DE (US)

(72) Inventor: Ramasamy Thiyagarajan, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 305 days.

(21) Appl. No.: 15/405,350

(22) Filed: Jan. 13, 2017

(65) Prior Publication Data

US 2018/0199789 A1 Jul. 19, 2018

(51) Int. Cl.

| | |
|---|---|
| ***A47L 15/22*** | (2006.01) |
| ***A47L 15/00*** | (2006.01) |
| ***A47L 15/23*** | (2006.01) |

(52) U.S. Cl.

CPC ..... *A47L 15/22* (2013.01); *A47L 15/0049* (2013.01); *A47L 15/23* (2013.01); *A47L 2401/24* (2013.01)

(58) Field of Classification Search

CPC ..... A47L 15/004; A47L 15/22; A47L 15/23; A47L 15/04; A47L 15/0049; A47L 2401/24

See application file for complete search history.

(56) References Cited

U.S. PATENT DOCUMENTS

| | | | | |
|---|---|---|---|---|
| 5,331,986 | A * | 7/1994 | Lim | A47L 15/4221 134/200 |
| 9,119,521 | B2 * | 9/2015 | Delgado | A47L 15/22 |
| 2010/0043826 | A1 * | 2/2010 | Bertsch | A47L 15/23 134/18 |
| 2018/0008117 | A1 * | 1/2018 | Pleschinger | A47L 15/0055 |

FOREIGN PATENT DOCUMENTS

| | | | |
|---|---|---|---|
| DE | 4418558 | A1 | 11/1995 |
| EP | 569733 | S1 | 11/1993 |
| EP | 2614763 | B1 * | 3/2015 |

OTHER PUBLICATIONS

Machine translation of EP-0569733-A1, dated May 1992. (Year: 1992).*

* cited by examiner

*Primary Examiner* — Joseph L. Perrin
*Assistant Examiner* — Kevin G Lee
(74) *Attorney, Agent, or Firm* — Dority & Manning, P.A.

(57) ABSTRACT

A dishwasher appliance includes a cabinet defining a wash chamber for receipt of articles for washing. The dishwasher appliance also includes a spray arm disposed within the wash chamber and rotatable about an axis. In addition, the spray arm defines an interior and aperture providing selective fluid communication between the interior and the wash chamber. The dishwasher appliance also includes a valve positioned within the interior of the spray arm, and the valve is stationary relative to the spray arm. The spray arm is rotatable between a first position and a second position. In (Continued)

the first position, the valve allows fluid communication between the interior and the wash chamber through the aperture. In contrast, when the spray arm is in the second position, the valve obstructs fluid communication between the interior and the wash chamber through the aperture.

17 Claims, 15 Drawing Sheets

VALVE FOR A SPRAY ARM OF A DISHWASHER APPLIANCE

FIELD OF THE INVENTION

The present disclosure relates generally to dishwasher appliances, and more particularly to a valve for a spray arm of a dishwasher appliance.

BACKGROUND OF THE INVENTION

Dishwasher appliances generally include a tub that defines a wash chamber. Rack assemblies can be mounted within the wash chamber of the tub for receipt of articles for washing. During wash and rinse cycles, spray arms within the wash chamber can apply or direct wash fluid (e.g. various combinations of water and detergent along with optional additives) towards articles disposed within the rack assemblies in order to clean such articles.

Multiple spray arms can be provided including e.g., a lower arm assembly mounted to the tub at a bottom of the wash compartment, a mid-level spray arm assembly mounted to one of the rack assemblies, and/or an upper spray arm assembly mounted to the tub at a top of the wash compartment. Other configurations may be used as well.

One limitation of many currently known spray arms is the inability to monitor operation thereof. During wash and rinse cycles, rotation of the spray arm may become obstructed by an article (e.g., plate, glass etc.) positioned within a rotational path of the spray arm. Alternatively, one or more driving jets responsible for rotation of the spray arm may become clogged and preclude further rotation of the spray arm. In either instance, articles are not being properly cleaned during operation of the dishwasher appliance.

Accordingly, a spray arm capable of being monitored throughout wash and rinse cycles is desired.

BRIEF DESCRIPTION OF THE INVENTION

Aspects and advantages of the invention will be set forth in part in the following description, or may be obvious from the description, or may be learned through practice of the invention.

In one embodiment, a dishwasher appliance includes a cabinet, a spray arm, and a valve. The cabinet may define a wash chamber for receipt of articles for washing. The spray arm may be disposed within the wash chamber. In addition, the spray arm may define an interior and aperture providing selective fluid communication between the interior and the wash chamber. The valve may be positioned within the interior of the spray arm. In addition, the spray arm may be rotatable between a first position and a second position. In the first position, the valve may allow fluid communication between the interior and the wash chamber through the aperture. In contrast, when the spray arm is in the second position, the valve may obstruct fluid communication between the interior and the wash chamber through the aperture.

In another embodiment, a dishwasher appliance defines lateral, transverse, and vertical directions that are mutually perpendicular to one another. In addition, the dishwasher appliance includes a cabinet, a spray arm, a valve, a sensor, and a controller. The cabinet may define a wash chamber for receipt of articles for washing. The spray arm may be disposed within the wash chamber. In addition, the spray arm may define an interior and aperture providing selective fluid communication between the interior and the wash chamber. The valve may be positioned within the interior of the spray arm. In addition, the sensor may be operable to detect a pressure of a fluid flowing from a pump of the dishwasher appliance to the interior of the spray arm. The controller may be communicatively coupled to the sensor, and the controller may be configured to determine a rotational speed of the spray arm based, at least in part, on the pressure of the fluid. In addition, the spray arm may be rotatable between a first position and a second position. In the first position, the valve may allow fluid communication between the interior and the wash chamber through the aperture. In contrast, when the spray arm is in the second position, the valve may obstruct fluid communication between the interior and the wash chamber through the aperture.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
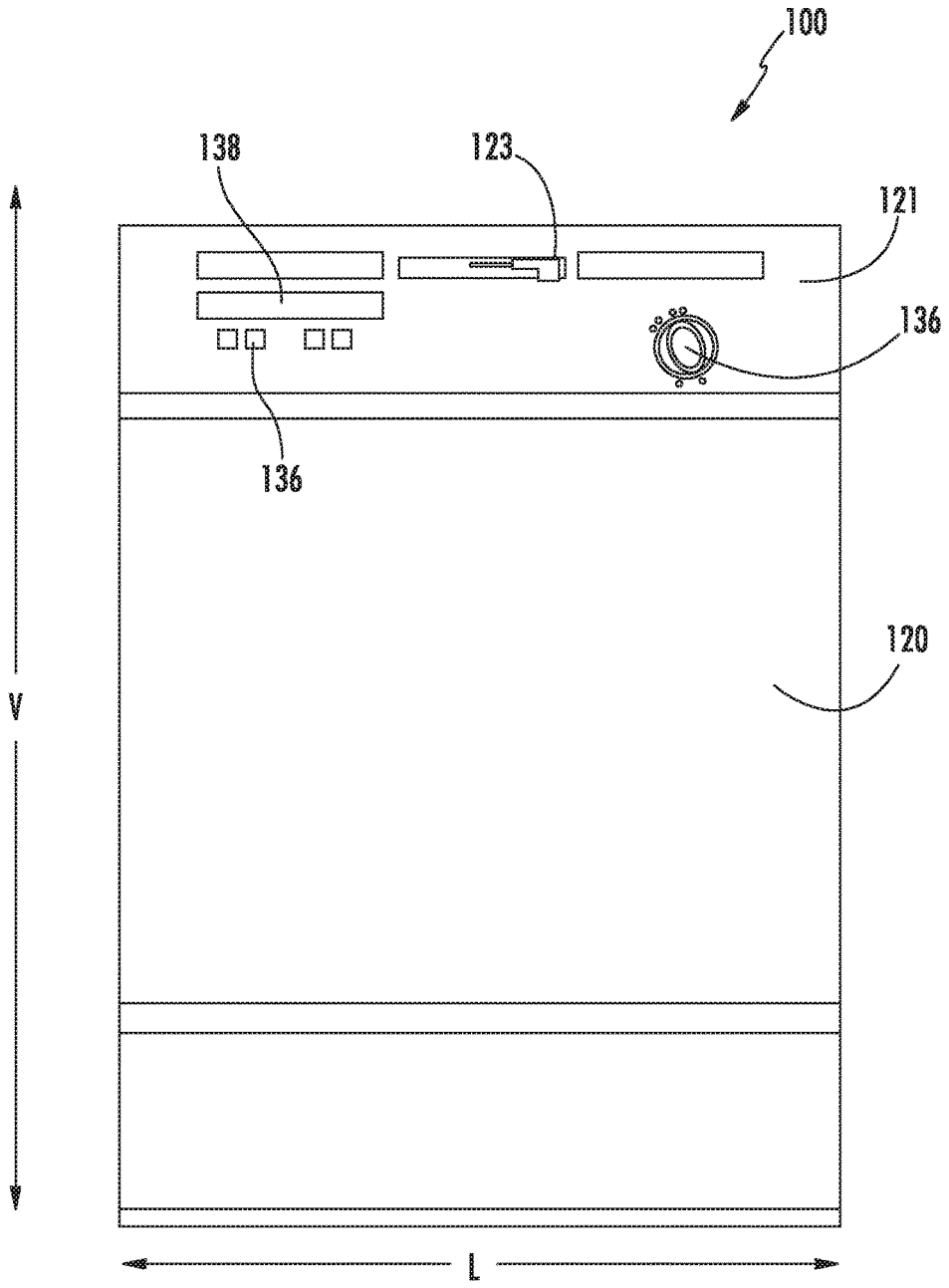
FIG. 1 provides a front view of a dishwasher appliance in accordance with embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "article" may refer to but need not be limited to dishes, pots, pans, silverware, and other cooking utensils and items that can be cleaned in a dishwashing appliance. The term "wash cycle" is intended to refer to one or more periods of time during which a dishwashing appliance operates while containing the articles to be washed and uses a detergent and water, preferably with agitation, to e.g., remove soil particles including food and other undesirable elements from the articles. The term "rinse cycle" is intended to refer to one or more periods of time in which the dishwashing appliance operates to remove residual soil, detergents, and other undesirable elements that were retained by the articles after completion of the wash cycle. The term "wash fluid" refers to a liquid used for washing and/or rinsing the articles and is typically made up of water that may include other additives such as detergent or other treatments.

Figure 2:
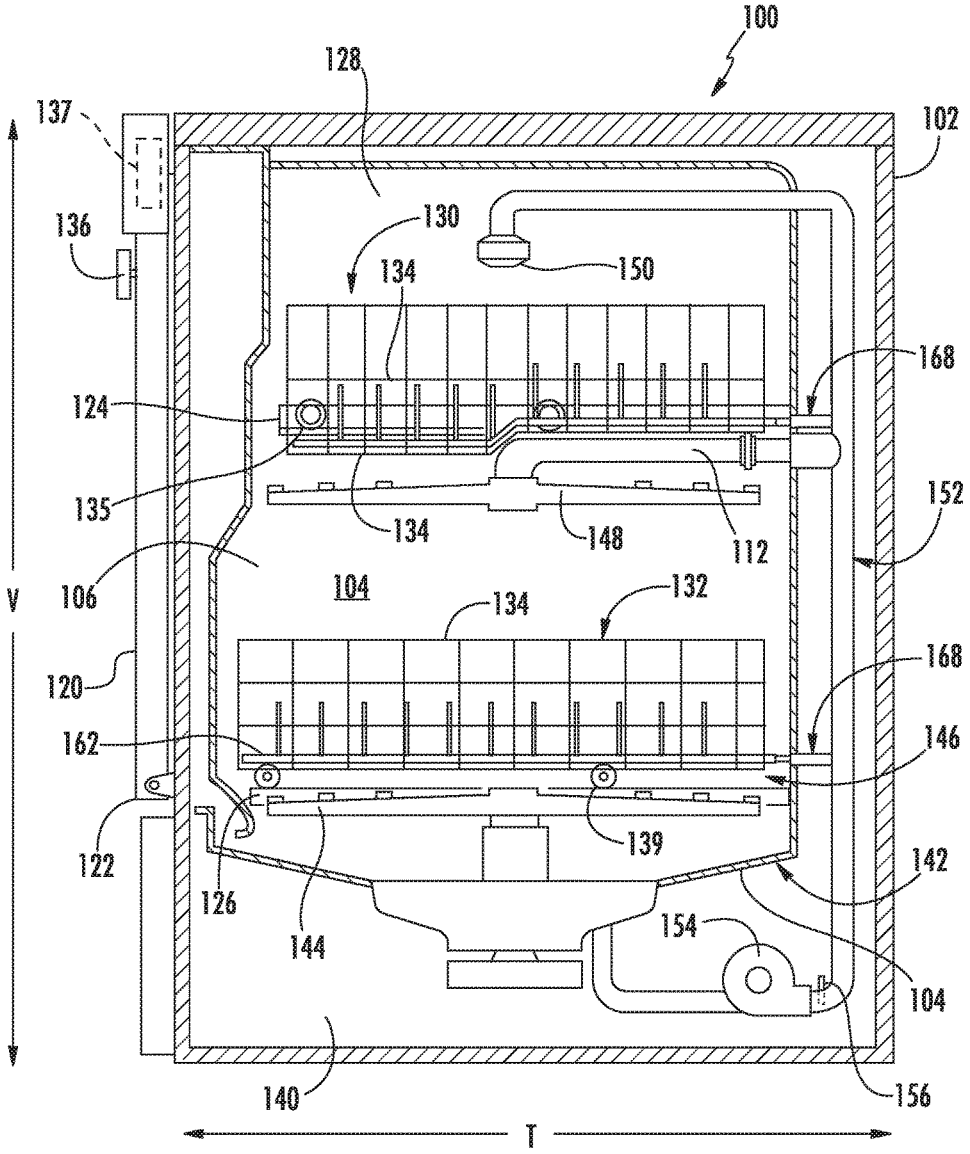
FIG. 2 provides a side cross-sectional view of a dishwasher appliance in accordance with embodiments of the present disclosure.
Figure 3:
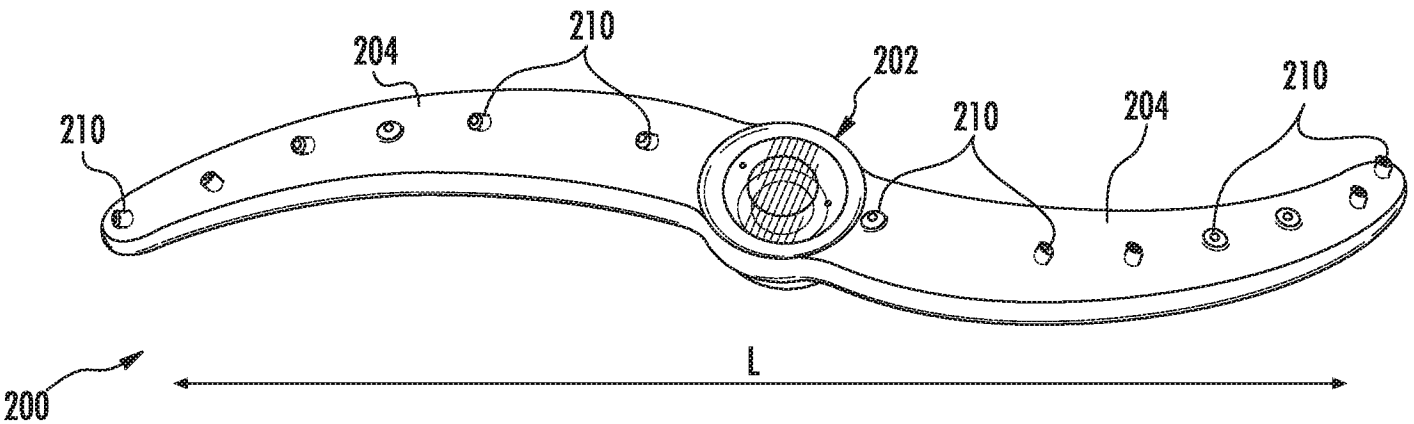
FIG. 3 provides a perspective view of a spray arm in accordance with one embodiments of the present disclosure.
Figure 4:
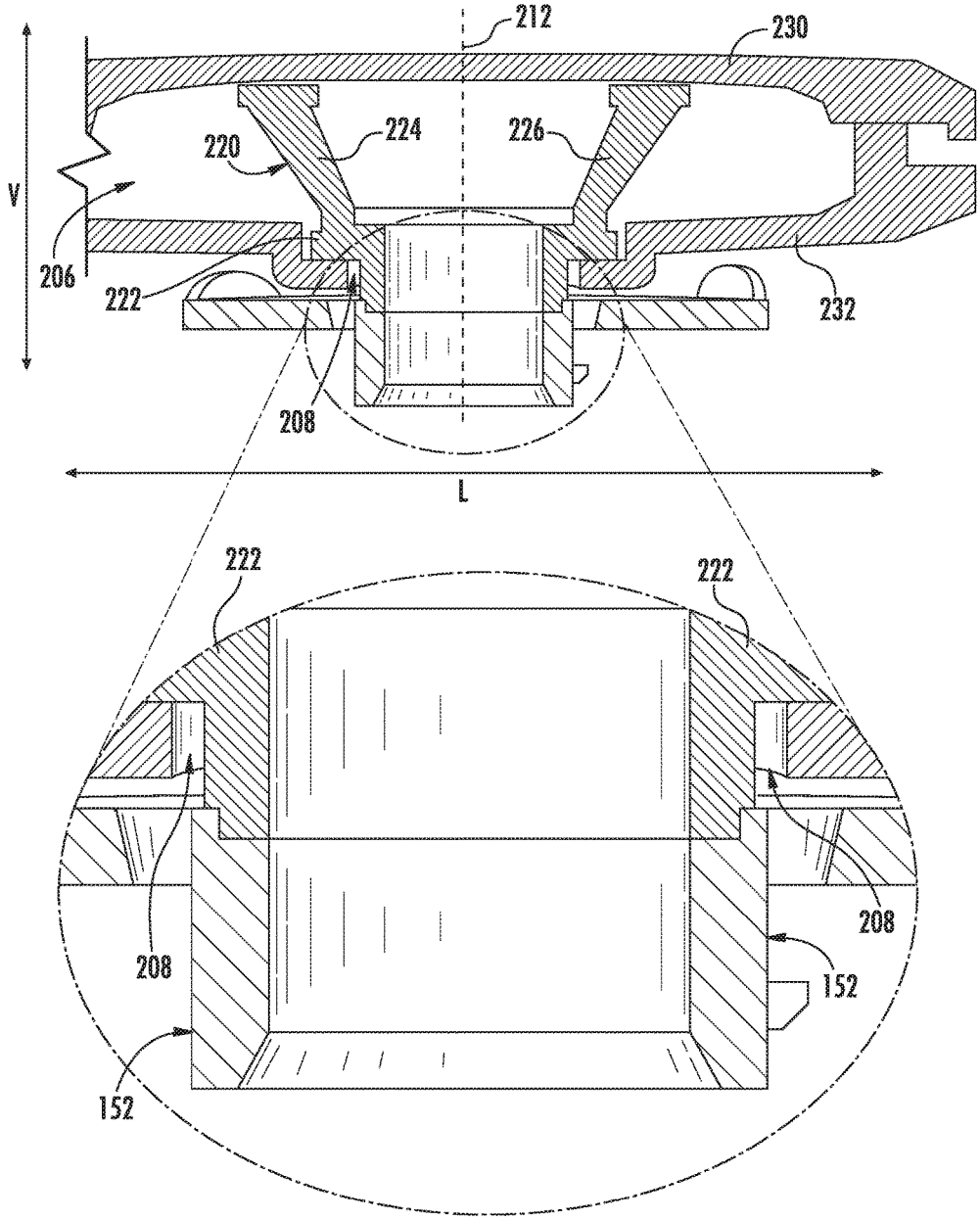
FIG. 4 provides a front cross-sectional view of a portion of a spray arm in accordance with embodiments of the present disclosure.

FIGS. 1 and 2 depict a dishwasher appliance 100 that may be configured in accordance with aspects of the present disclosure. As shown, the dishwasher appliance 100 defines a lateral direction L, a transverse direction T, and a vertical direction V, each mutually perpendicular to one another. The dishwasher appliance 100 includes a cabinet 102 having a tub 104 therein that defines a wash chamber 106. The tub 104 includes a front opening (not shown) and a door 120 hinged at its bottom 122 for movement between a normally closed vertical position (shown in FIGS. 1 and 2), wherein the wash chamber 106 is sealed shut for washing operation, and a horizontal open position for loading and unloading of articles from the dishwasher. Latch 123 is used to lock and unlock door 120 for access to chamber 106.

Upper and lower guide rails 124, 126 are mounted on tub side walls 128 and accommodate roller-equipped rack assemblies 130 and 132. Each of the rack assemblies 130, 132 is fabricated into lattice structures including a plurality of elongated members 134 (for clarity of illustration, not all elongated members making up assemblies 130 and 132 are shown in FIG. 2). Each rack 130, 132 is adapted for movement between an extended loading position (not shown) in which the rack is substantially positioned outside the wash chamber 106, and a retracted position (shown in FIGS. 1 and 2) in which the rack is located inside the wash chamber 106. This is facilitated by rollers 135 and 139, for example, mounted onto racks 130 and 132, respectively. A silverware basket (not shown) may be removably attached to rack assembly 132 for placement of silverware, utensils, and the like, that are otherwise too small to be accommodated by the racks 130, 132.

The dishwasher appliance 100 further includes a lower spray-arm assembly 144 that is rotatably mounted within a lower region 146 of the wash chamber 106 and above a tub sump portion 142 so as to rotate in relatively close proximity to rack assembly 132. A mid-level spray-arm assembly 148 is located in an upper region of the wash chamber 106 and may be located in close proximity to upper rack 130 along the vertical direction V. Additionally, an upper spray assembly 150 may be located above the upper rack 130 along the vertical direction V.

The lower and mid-level spray-arm assemblies 144, 148 and the upper spray assembly 150 are fed by a fluid circulation assembly 152 for circulating water and dishwasher fluid in the tub 104. The fluid circulation assembly 152 may include a pump 154 located in a machinery compartment 140 located below the bottom sump portion 142 of the tub 104, as generally recognized in the art. Each spray-arm assembly 144, 148 includes an arrangement of discharge ports or orifices for directing washing liquid onto dishes or other articles located in rack assemblies 130 and 132. The arrangement of the discharge ports, also referred to as jets or apertures, in spray-arm assemblies 144, 148 provides a rotational force by virtue of washing fluid flowing through the discharge ports. The resultant rotation of the lower and mid-level spray-arm assemblies 144, 148 provides coverage of dishes and other dishwasher contents with a washing spray.

The dishwasher 100 is further equipped with a controller 137 to regulate operation of the dishwasher 100. The controller may include a memory and one or more microprocessors, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor.

The controller 137 may be positioned in a variety of locations throughout dishwasher 100. In the illustrated embodiment, the controller 137 may be located within a control panel area 121 of door 120 as shown. In such an embodiment, input/output ("I/O") signals may be routed between the control system and various operational components of dishwasher 100 along wiring harnesses that may be routed through the bottom 122 of door 120. Typically, the controller 137 includes a user interface panel 136 through which a user may select various operational features and modes and monitor progress of the dishwasher 100. In one embodiment, the user interface 136 may represent a general purpose I/O ("GPIO") device or functional block. In one embodiment, the user interface 136 may include input components, such as one or more of a variety of electrical, mechanical or electro-mechanical input devices including rotary dials, push buttons, and touch pads. The user interface 136 may include a feedback device 138, such as a digital or analog display device designed to provide operational feedback to a user. The user interface 136 may be in communication with the controller 137 via one or more signal lines or shared communication busses.

The dishwasher appliance 100 may also include a sensor 156 that is communicatively coupled to the controller 137 via any suitable wired or wireless connection. In one embodiment, the sensor 156 may be operable to detect a discharge pressure of the pump 154. More specifically, the sensor 156 may be operable to detect a pressure of a fluid (e.g., wash fluid) flowing from the pump 154 to each of the one or more spray assemblies 144, 148, 150. As will be discussed below in more detail, the controller 137 may be configured to determine operation of the one or more spray-arm assemblies 144, 148 based, at least in part, on the pressure detected by the sensor 156.

Referring now to FIGS. 3 through 7, an embodiment of a spray arm 200 is illustrated. The spray arm 200 may be utilized in the dishwasher appliance 100. In one embodiment, the spray arm 200 is the mid-level spray arm assembly 148 of the dishwasher appliance 100. In an alternative embodiment, the spray arm 200 may be the lower spray-arm assembly 144 or the upper spray assembly 150, or may be utilized in any other suitable position within dishwasher appliance 100. For example, in some embodiments, the spray arm 200 may be mounted to a rear wall of the wash chamber 106. The spray arm 200 may generally be in fluid communication with the fluid circulation assembly 152 to receive wash fluid therefrom. The wash fluid is then flowed through the spray arm 200 and exhausted therefrom into the wash chamber 106 during operation of the dishwasher appliance 100, such as during a wash or rinse cycle.

As shown, the spray arm 200 includes a hub 202 and one or more arms extending from the hub 202. More specifically, the one or more arms may include a pair of arms 204 extending in opposing directions along the lateral direction L. The spray arm 200 defines an interior 206 in fluid communication with the fluid circulation assembly 152 to receive wash fluid therefrom. In one embodiment, wash fluid enters the interior 206 of the spray arm 200 through an aperture 208 defined by the hub 202.

In addition, each arm of the pair of arms 204 defines a plurality of discharge ports 210 spaced apart from one another along the lateral direction L. Furthermore, it should be appreciated that each discharge port of the plurality of discharge ports 210 is in fluid communication with the interior 206 of the spray arm 200. Accordingly, wash fluid entering the interior 206 through the aperture 208 may be emitted into the wash chamber 106 through the plurality of discharge ports 210.

It should be appreciated that the hub 202 of the spray arm 200 may define a central axis 212 extending therethrough, which may for example be generally perpendicular to the lateral direction L. Accordingly, the spray arm 200, including the pair of spray arms 204, may be rotatable about the central axis 212.

Figure 5:
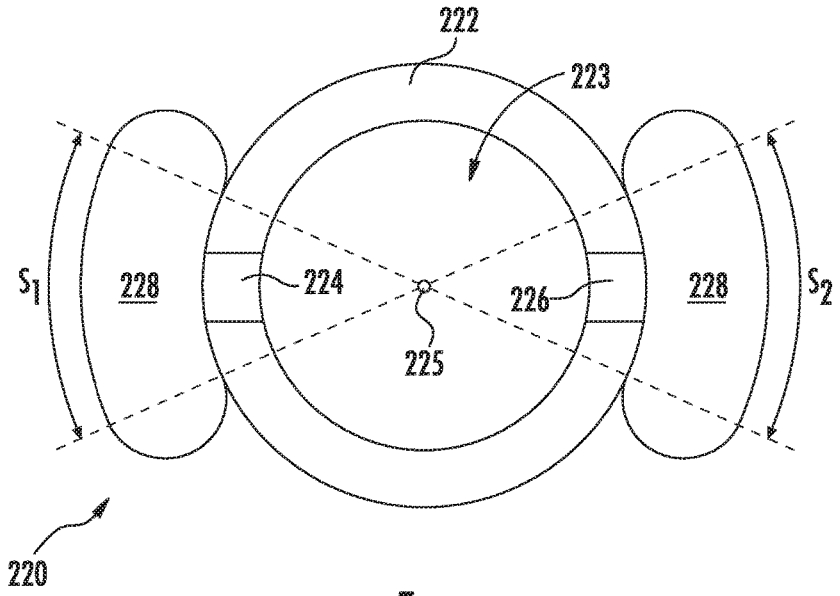
FIG. 5 provides a top-down view of a valve in accordance with embodiments of the present disclosure.

As shown in FIGS. 4-8, a valve 220 may be positioned within the interior 206 of the spray arm 200. The valve 220 is stationary relative to rotation of the spray arm about the central axis 212, and the valve 220 includes a base 222, a first support 224 and a second support 226. As shown in FIG. 5, the base 222 is annular (ring-shaped) and defines an opening 223 having a center point 225. However, it should be appreciated that the base 222 may define any suitable shape.

Figure 6:
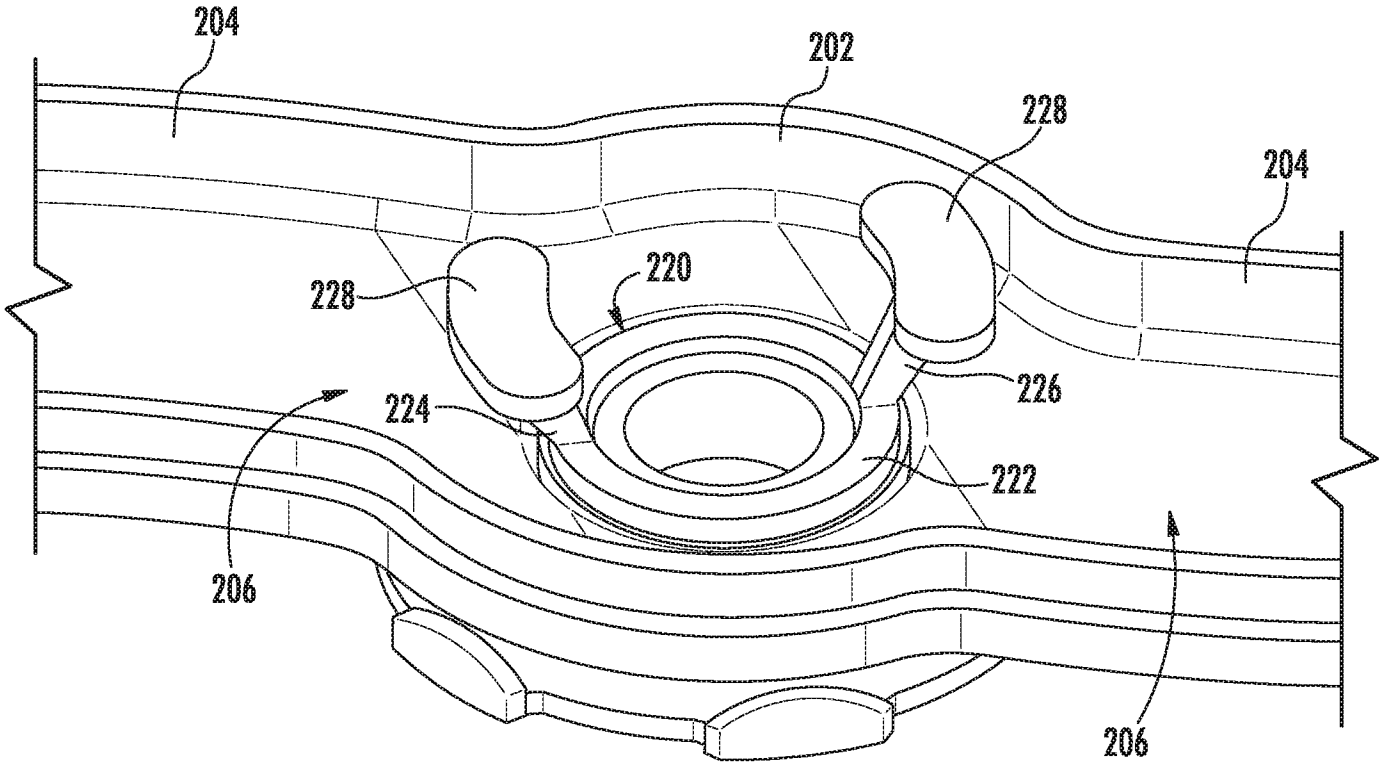
FIG. 6 provides a cutaway view of an interior of a spray arm in accordance with embodiments of the present disclosure.

Referring now to FIG. 6, the first and second supports 224, 226 are circumferentially spaced apart from one another on the base 222. In addition, the first and second supports 224, 226 each extend away from the base 222 along the vertical direction V. The first and second supports 224, 226 each also include a blocking member 228. The blocking member 228 of both the first and second supports 224, 226 is positioned between top and bottom portions 230, 232 of the hub 202 along the vertical direction V.

Referring again briefly to FIG. 4, the blocking member 228 of the first support 224 defines a first arc length $S_1$, and the blocking member 228 of the second support 226 defines a second arc length $S_2$. It should be appreciated that the first and second arc lengths $S_1$, $S_2$ may define any suitable value. In one embodiment, the first arc length $S_1$ may be equal to the second arc length $S_2$. In another embodiment, the first arc length $S_1$ may be different than the second arc length $S_2$, such as greater than or less than the second arc length $S_2$. It should also be appreciated that the blocking member 228 of the first and second supports 224, 226 may define any suitable cross-section. In addition, it should be appreciated that a surface area of the blocking member 228 of the first support 224 may be different than a surface area of the blocking member 228 of the second support 226.

Figure 7:
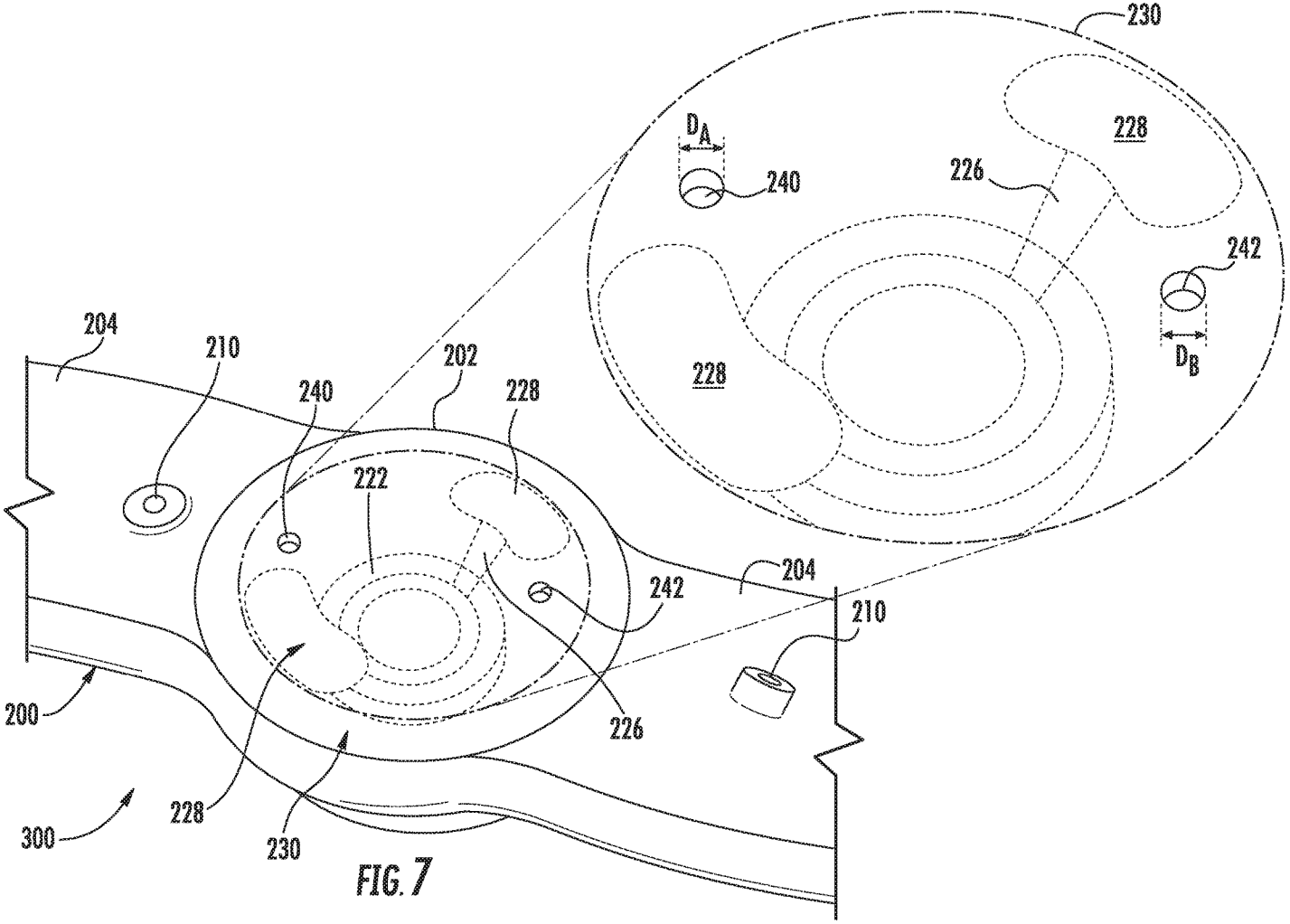
FIG. 7 provides a top, perspective view of a portion of a spray arm in a first position in accordance with embodiments of the present disclosure.
Figure 8:
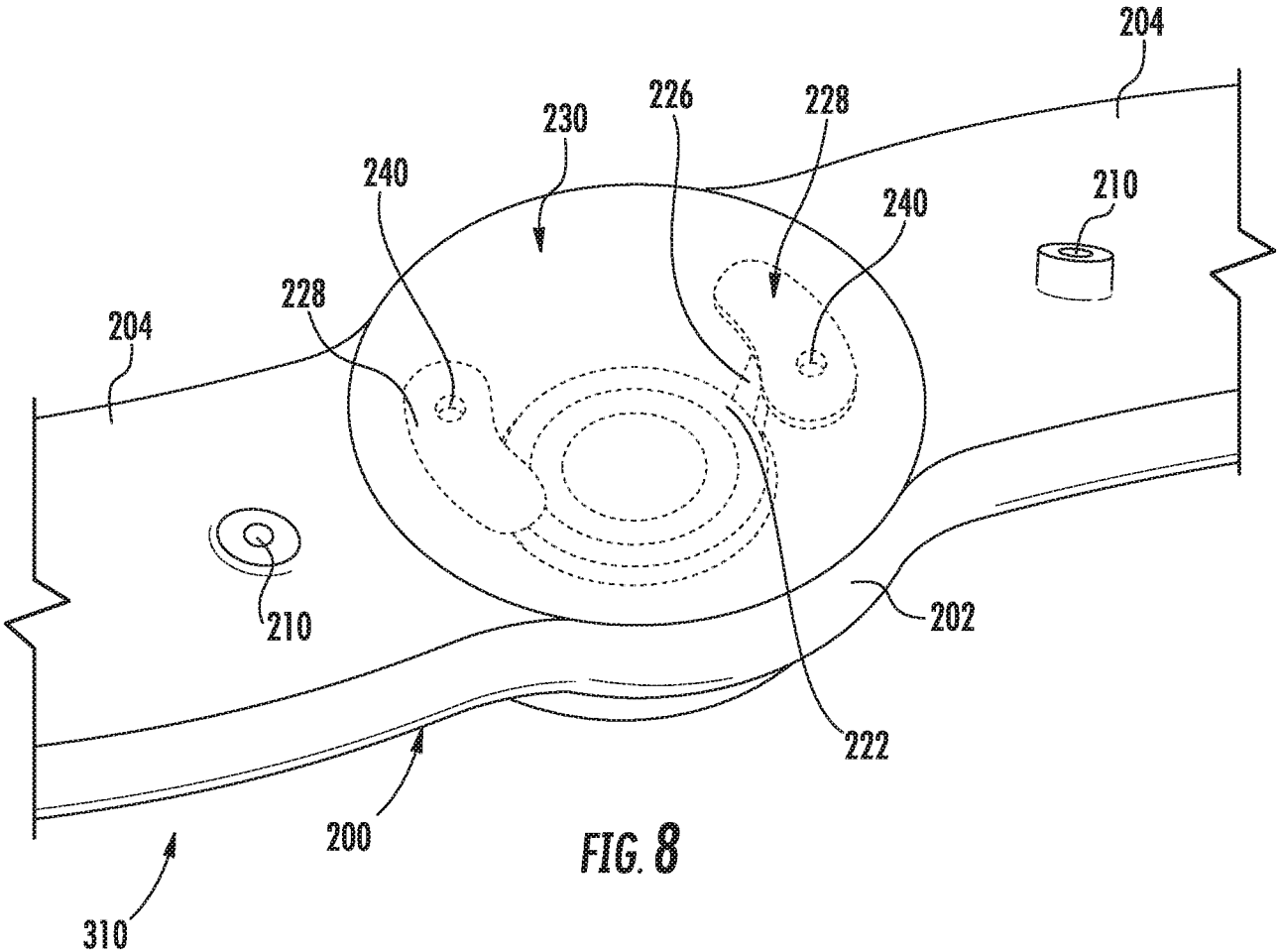
FIG. 8 provides a top, perspective view of a portion of a spray arm in a second position in accordance with embodiments of the present disclosure.

Referring now to FIGS. 7 and 8, the spray arm 200 may define one or more apertures to provide selective fluid communication between the interior 206 of the wash chamber 106 (FIG. 2). As shown, the hub 202 (e.g., the top portion 230) of the spray arm 200 may define a first aperture 240 and second aperture 242. In addition, both the first and second apertures 240, 242 may extend through the top portion 230 of the hub 202 and into the interior 206 of the spray arm 200. As will be discussed below in more detail, the first and second apertures 240, 242 may provide selective fluid communication between the interior 206 and the wash chamber 106 (FIG. 2) based, at least in part, on a rotational position of the spray arm 200.

In the embodiment depicted, both the first and second apertures 240, 242 define a circular cross-section. More specifically, the first aperture 240 defines a maximum diameter $D_A$, and the second aperture 242 defines a maximum diameter $D_B$. In some embodiments, the maximum diameter $D_A$ of the first aperture 240 may be equal to the maximum diameter $D_B$ of the second aperture 242. In alternative embodiments, the maximum diameter $D_A$ of the first aperture 240 may be different than the maximum diameter $D_B$ of the second aperture 242, such as greater than or less than the maximum diameter $D_B$ of the second aperture 242. It should be appreciated, however, that the first and second apertures 240, 242 may define any suitable cross-section. For example, in alternative embodiments, at least one of the first and second apertures 240, 242 may define a square or rectangular cross-section.

Referring now to FIGS. 6-8, the spray arm 200 is rotatable during wash and rinse cycles of the dishwasher appliance 100 (FIG. 1). More specifically, the spray arm 200 is rotatable to a first position 300 in which the valve 220 does not obstruct fluid communication between the interior 206 of the spray arm 200 and the wash chamber 106 through the first and second apertures 240, 242. More specifically, the blocking member 228 of the first and second supports 224, 226 does not obstruct wash fluid from exiting the interior 206 of the spray arm 200 through the first and second apertures 240, 242. In addition, the sensor 156 (FIG. 2) may detect a first pressure $P_1$ when the spray arm 200 is in the first position 300. More specifically, the first pressure $P_1$ indicates a discharge pressure of the pump 154 (FIG. 2) when the spray arm 200 is in the first position 300.

The spray arm 200 is also rotatable to a second position 310 that is different than the first position 300. More specifically, when the spray arm 200 is in the second position 310, the valve 220 obstructs fluid communication between the interior 206 of the spray arm 200 and the wash chamber 106 through the first and second apertures 240, 242. In the embodiment depicted, the blocking member 228 of the first support 224 obstructs wash fluid from exiting the interior 206 through the first aperture 240, and the blocking member 228 of the second support 226 obstructs wash fluid from exiting the interior 206 through the second aperture 242. In addition, the sensor 156 (FIG. 2) detects a second pressure $P_2$ when the spray arm 200 is in the second position 310. More specifically, the second pressure $P_2$ indicates a discharge pressure of the pump 154 when the spray arm 200 is in the second position 310. It should be appreciated that the second pressure $P_2$ is different than the first pressure $P_1$. More specifically, the second pressure $P_2$ is greater than the first pressure $P_1$.

Figure 9:
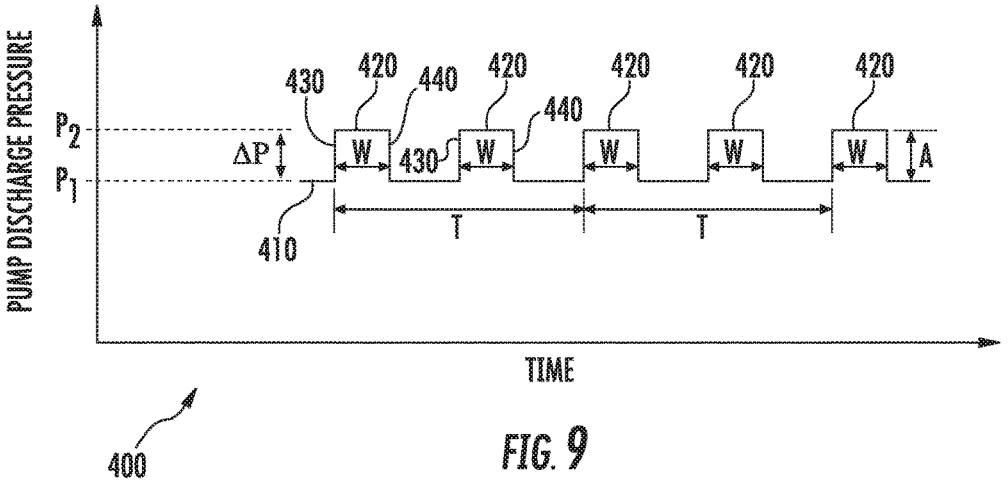
FIG. 9 provides a graph illustrating changes in a pressure of a fluid due to rotation of a spray arm between the first and second positions of FIGS. 6 and 7.

FIG. 9 depicts a graph 400 of a time-varying pressure signal 410 indicating rotation of the spray arm 200. The time-varying pressure signal 410 includes a plurality of pulses 420, and each pulse of the plurality of pulses 420 includes a rising edge 430 and a falling edge 440. In one embodiment, the rising edge 430 indicates rotation of the spray arm 200 from the first position 300 (FIG. 7) to the second position 310 (FIG. 8), and the falling edge 440 indicates rotation of the spray arm 200 from the second position 310 (FIG. 8) to the first position 300 (FIG. 7). Accordingly, each pulse of the plurality of pulses 420 indicate a pressure differential ΔP that the sensor 156 (FIG. 2) detects when the spray arm 200 rotates from the first position 300 to the second position 310, or vice versa. It should be appreciated that the time-varying pressure signal 410 indicates a constant pressure, such as the first or second pressure $P_1$ and $P_2$, when rotation of the spray arm 200 is prevented. For example, if the spray arm 200 stalls in the first position 300 (FIG. 7), the time-varying pressure signal 410 would indicate a constant pressure, such as the first pressure $P_1$, until the spray arm 200 resumed rotating and rotated to the second position 310 (FIG. 8).

As shown, each pulse of the plurality of pulses 420 may define a width W and amplitude A. It should be appreciated that the width W of each pulse of the plurality of pulses 420 may depend on the first and second arc lengths $S_1$, $S_2$ (FIG. 5). More specifically, the first and second arc lengths $S_1$, $S_2$ may affect an amount of time the spray arm 200 is in the first and second positions 300, 310 during rotation thereof. It should also be appreciated that the amplitude A of each pulse of the plurality of pulses 420 may depend on the maximum diameters $D_A$, $D_B$ of the first and second apertures 240, 242. More specifically, the maximum diameter $D_A$, $D_B$ may affect the pressure differential ΔP that the sensor 156 detects when the spray arm 200 rotates from the first position 300 to the second position 310, or vice versa.

Still referring to FIG. 9, a period T of the time-varying pressure signal 410 may correspond to one revolution of the spray arm 200. More specifically, the period T of the time-varying pressure signal 410 includes two consecutive pulses 420. In addition, a frequency f of the time-varying pressure signal 410 may be equal to the inverse of the period T. More specifically, the frequency f of the time-varying pressure signal 410 may indicate a frequency with which the pressure differential ΔP occurs due to rotation of the spray arm 200 between the first and second position 300, 310 (FIGS. 7 and 8). As will be discussed below in more detail, the controller 137 (FIG. 2) may be configured to determine operation of the spray arm 200 based, at least in part, on the time-varying pressure signal 410.

In one embodiment, the controller 137 (FIG. 2) may be configured to determine a rotational speed of the spray arm 200 based on the frequency f of the time-varying pressure signal 410. More specifically, the controller 137 may be configured to determine the rotational speed of the spray arm 200 based on the frequency with which the sensor 156 (FIG. 2) detects the pressure differential ΔP due to rotation of the spray arm 200 between the first and second position 300, 310 (FIGS. 7 and 8). In some embodiments, the controller 137 may be configured to continuously determine the rotational speed of the spray arm 200 during wash and rinse cycles. In alternative embodiments, the controller 137 may be configured to periodically determine the rotational speed of the spray arm 200 during wash and rinse cycles. More specifically, the controller 137 may be configured to determine the rotational speed of the spray arm 200 at predefined intervals during wash and rinse cycles of the dishwasher appliance 100 (FIG. 1).

In addition, the controller 137 may be further configured to generate an alarm based, at least in part, on the rotational speed of the spray arm 200. More specifically, the controller 137 may generate the alarm when the rotational speed of the spray arm 200 is less than or equal to a predetermined value. In one embodiment, the alarm may be present on the feedback device 138 of the user interface 136 of the dishwasher appliance 100. In another embodiment, the alarm may be displayed on a mobile device (e.g., smart phone, tablet, etc.) that is communicatively coupled to the controller 137 via any suitable wired or wireless connection.

The controller 137 may also be configured to adjust operation of the pump 154 based, at least in part, on the rotational speed of the spray arm 200. For example, if the rotational speed of the spray arm 200 is less than or equal to the predetermined value, the controller 137 may determine rotation of the spray arm 200 is prohibited by an article (e.g., glass, plate, etc.) within the wash chamber 106. As such, the controller 137 may generate a command to adjust a speed at which the pump 154 is operating. More specifically, the controller 137 may generate a command to reduce the speed at which the pump 154 is operating in order to reduce the flow of wash fluid to the spray arm 200. Accordingly, the dishwasher appliance 100 may operate in a more efficient manner.

Figure 10:
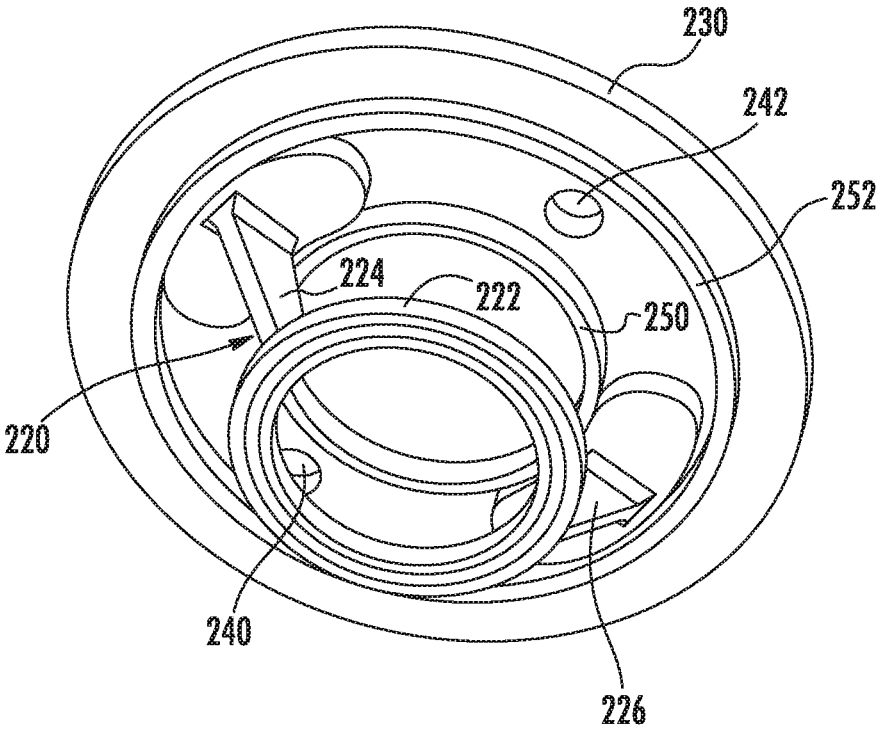
FIG. 10 provides a bottom, perspective view of a spray arm in accordance with embodiments of the present disclosure.
Figure 11:
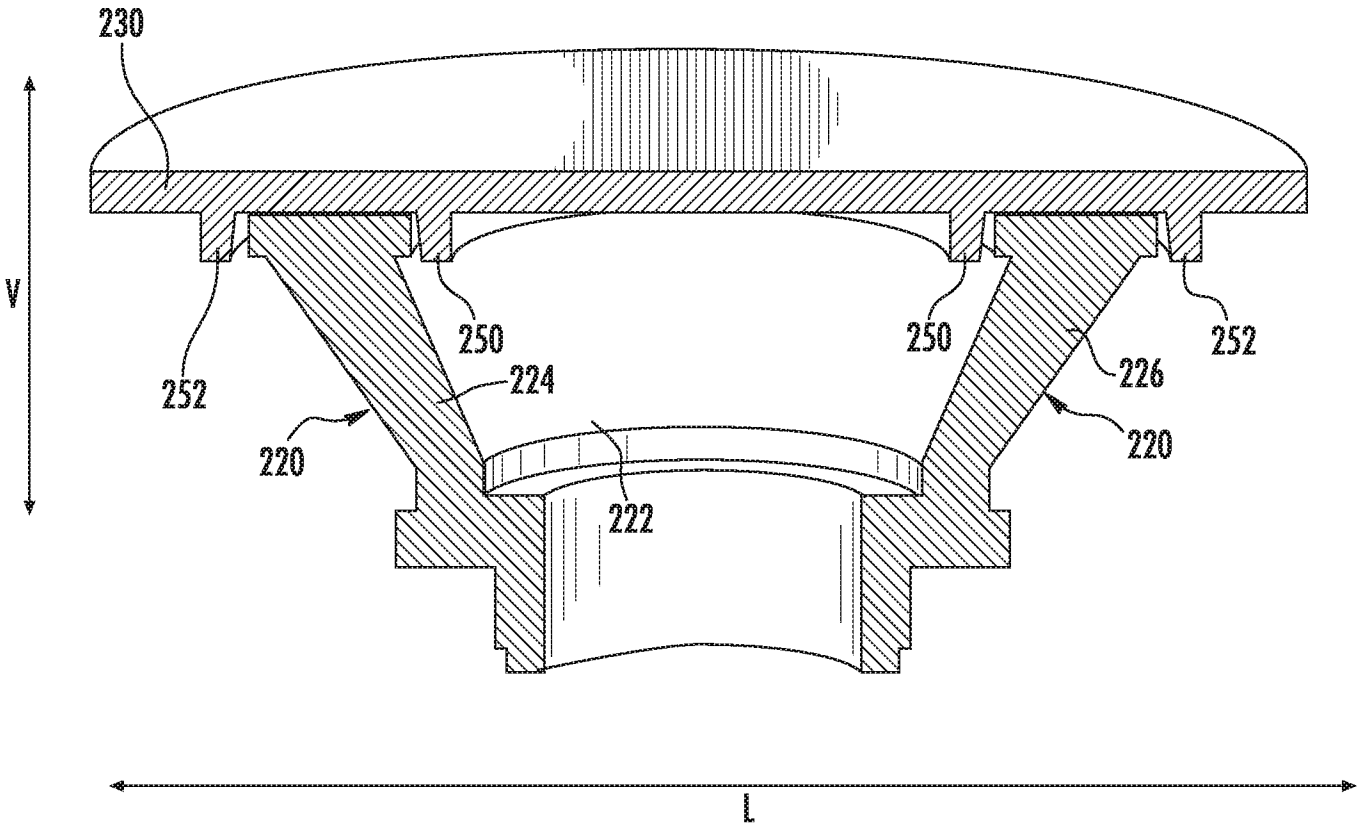
FIG. 11 provides a partial, cross-sectional view of a spray arm in accordance with embodiments of the present disclosure.

FIGS. 10 and 11 depict another embodiment of the spray arm 200. As shown, the spray arm 200 defines a pair of concentric walls 250, 252 extending into the interior 206 (FIG. 4) thereof. More specifically, each wall of the pair of concentric walls 250, 252 is defined by the top portion 230 of the hub 202. As shown, the first and second apertures 240, 242 are positioned between the pair of concentric walls 250, 252 along the lateral direction L. In addition, the blocking member 228 of the both the first and second supports 224, 226 is positioned between the pair of concentric walls 250, 252 along the lateral direction L. It should be appreciated that the pair of concentric walls 250, 252 supplement the valve 220 in preventing wash fluid from exiting the interior 206 through the first and second apertures 240, 242 when the spray arm 200 is in the second position 310 (FIG. 8).

Figure 12:
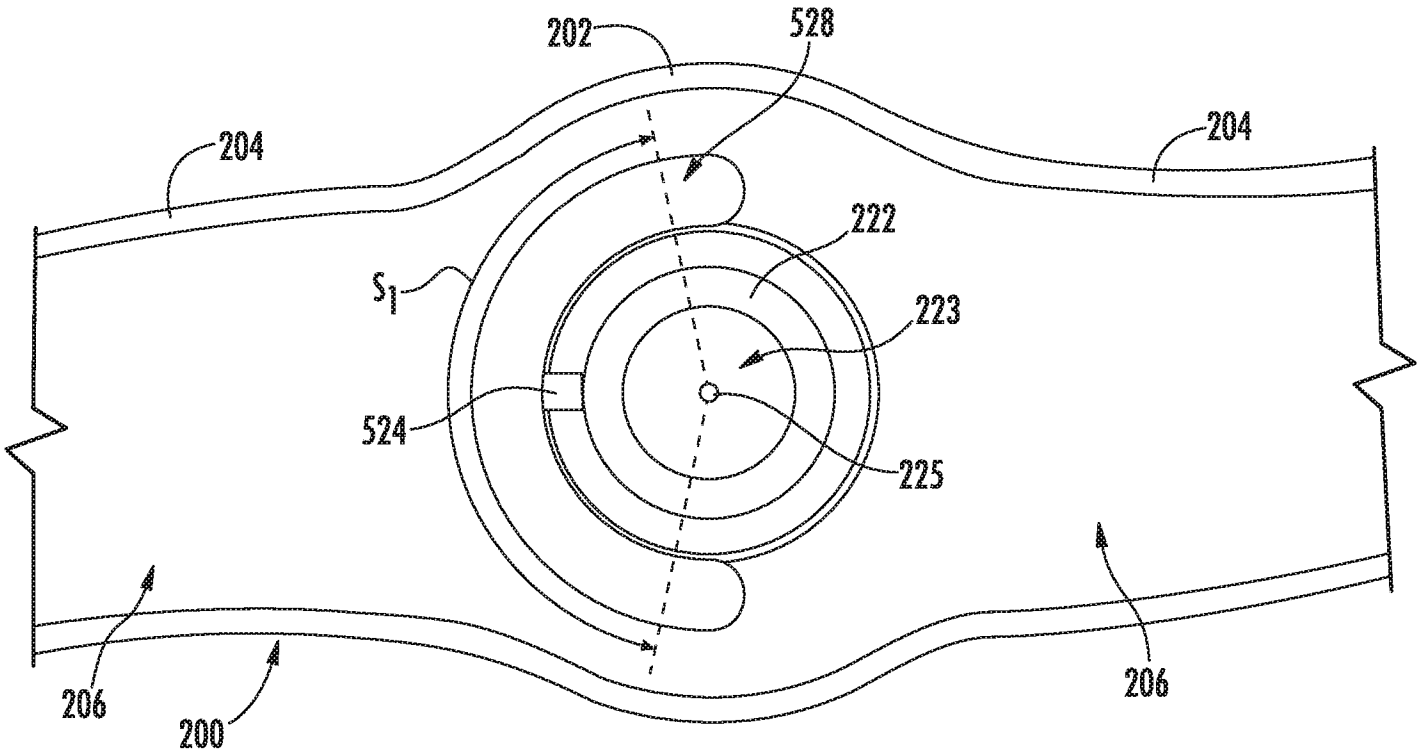
FIG. 12 provides a top, cutaway view of a spray arm in accordance with embodiments of the present disclosure.

FIG. 12 depicts yet another embodiment of the spray arm 200. It should be appreciated that the spray arm 200 of FIG. 12 may be configured in substantially the same manner as the spray arm 200 of FIG. 4 and, accordingly, the same or similar reference numbers may be used to indicate the same or similar parts. As shown, the spray arm 200 includes the valve 220 positioned within the interior 206 thereof. However, the valve 220 depicted in FIG. 12 includes a support 524 having a blocking surface 528. As shown, the blocking member 528 defines a first arc length $S_1$. It should be appreciated that the first arc length $S_1$ may be equal to any suitable value. For example, in one embodiment, the first arc length $S_1$ may be between $$\frac{\pi}{6}$$

radians and $$\frac{3\pi}{2}$$

radians.

Figure 13:
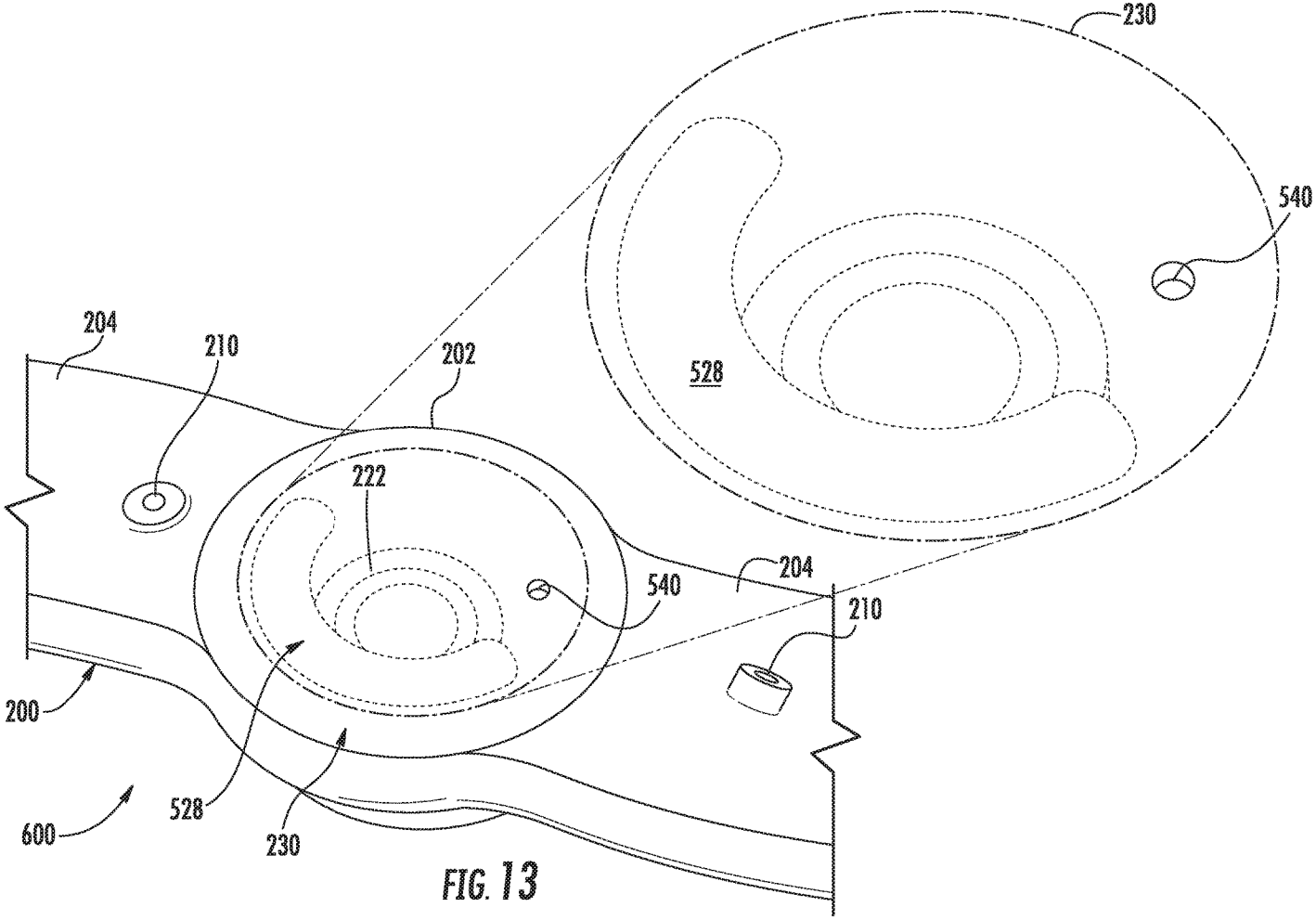
FIG. 13 provides a top, perspective view of a portion of a spray arm in a first position in accordance with embodiments of the present disclosure.
Figure 14:
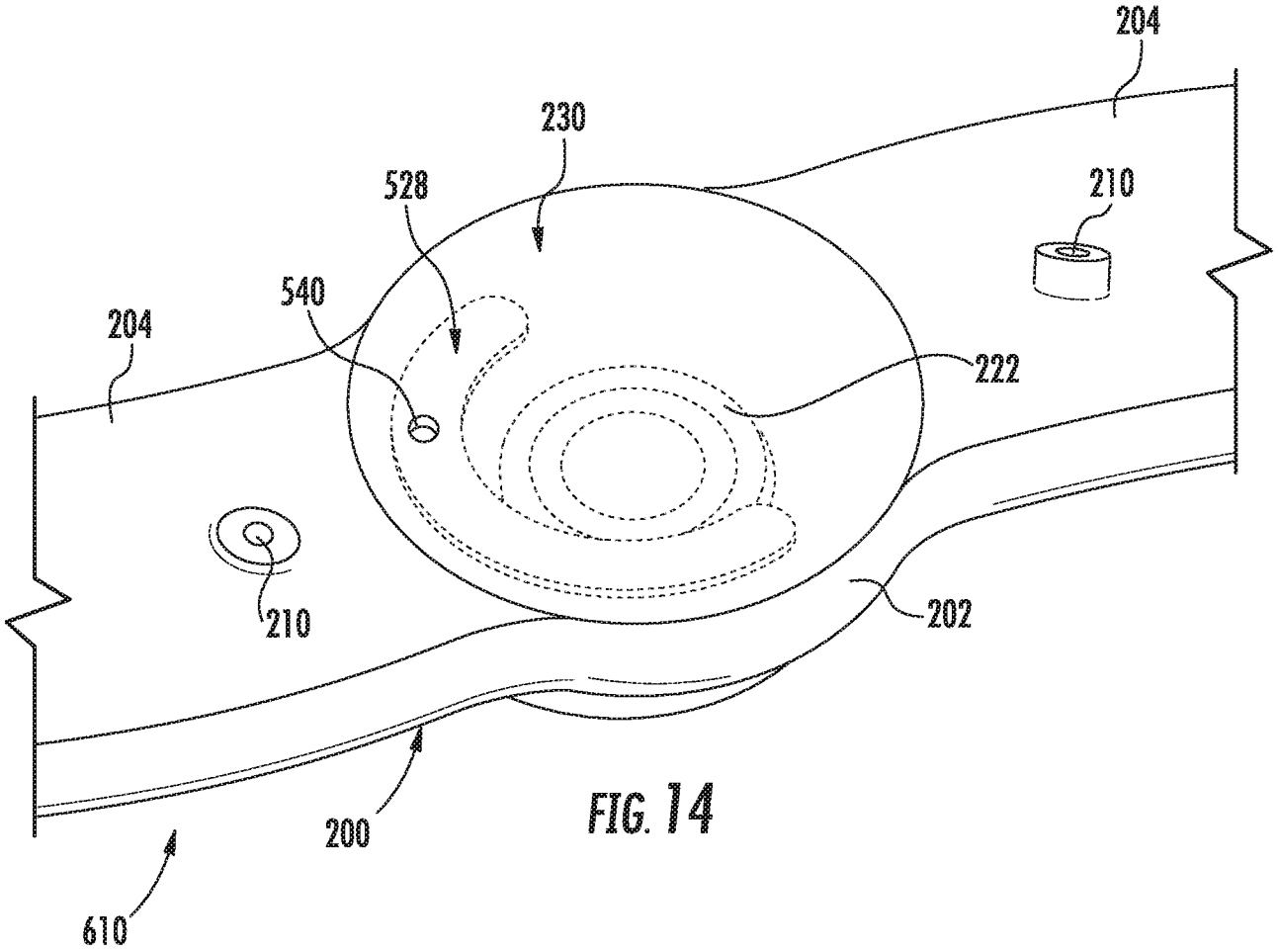
FIG. 14 provides a top, perspective view of a portion of a spray arm in a second position in accordance with embodiments of the present disclosure.

Referring now to FIGS. 13 and 14, the spray arm 200 of FIG. 12 may define an aperture 540 to provide selective fluid communication between the interior 206 of the wash chamber 106 (FIG. 2). As shown, the hub 202 (e.g., the top portion 230) of the spray arm 200 may define the aperture 540, and the aperture 540 may extend through the top portion 230 of the hub 202 and into the interior 206 of the spray arm 200. As will be discussed below in more detail, the aperture 540 may provide selective fluid communication between the interior 206 and the wash chamber 106 (FIG. 2) based, at least in part, on a rotational position of the spray arm 200.

Referring now to FIGS. 12-14, the spray arm 200 is rotatable during wash and rinse cycles of the dishwasher appliance 100 (FIG. 1). More specifically, the spray arm 200 is rotatable to a first position 600 in which the valve 220 does not obstruct fluid communication between the interior 206 of the spray arm 200 and the wash chamber 106 through the aperture 540. More specifically, the blocking member 528 of the support 524 does not obstruct wash fluid from exiting the interior 206 of the spray arm 200 through the aperture 540. In addition, the sensor 156 (FIG. 2) may detect a first pressure $P_1$ when the spray arm 200 is in the first position 600. More specifically, the first pressure $P_1$ indicates a discharge pressure of the pump 154 (FIG. 2) when the spray arm 200 is in the first position 600.

The spray arm 200 is also rotatable to a second position 610 that is different than the first position 300. More specifically, when the spray arm 200 is in the second position 610, the valve 220 obstructs fluid communication between the interior 206 of the spray arm 200 and the wash chamber 106 through the aperture 540. More specifically the blocking member 528 of the support 524 obstructs wash fluid from exiting the interior 206 through the aperture 540. In addition, the sensor 156 (FIG. 2) detects a second pressure $P_2$ when the spray arm 200 is in the second position 610. More specifically, the second pressure $P_2$ indicates a discharge pressure of the pump 154 when the spray arm 200 is in the second position 310. It should be appreciated that the second pressure $P_2$ is different than the first pressure $P_1$. More specifically, the second pressure $P_2$ is greater than the first pressure $P_1$.

Figure 15:
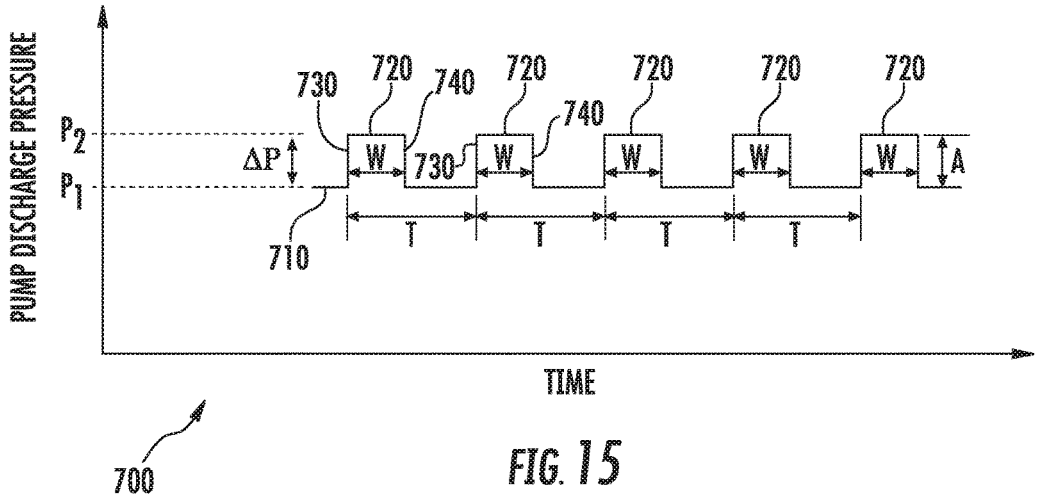
FIG. 15 provides a graph illustrating changes in a pressure of a fluid due to rotation of a spray arm between the first and second positions of FIGS. 13 and 14.

FIG. 15 depicts a graph 700 of a time-varying pressure signal 710 indicating rotation of the spray arm 200 of FIG. 12. The time-varying pressure signal 710 includes a plurality of pulses 720, and each pulse of the plurality of pulses 720 includes a rising edge 730 and a falling edge 740. In one embodiment, the rising edge 730 indicates rotation of the spray arm 200 from the first position 600 (FIG. 13) to the second position 610 (FIG. 14), and the falling edge 740 indicates rotation of the spray arm 200 from the second position 610 (FIG. 14) to the first position 600 (FIG. 13). Accordingly, each pulse of the plurality of pulses 720 indicates a pressure differential $\Delta P$ that the sensor 156 (FIG. 2) detects when the spray arm 200 rotates from the first position 600 to the second position 610, or vice versa. It should be appreciated that the time-varying pressure signal 710 indicates a constant pressure, such as the first or second pressure $P_1$ and $P_2$, when rotation of the spray arm 200 is prevented. For example, if the spray arm 200 stalls in the first position 600 (FIG. 13), the time-varying pressure signal 710 would indicate a constant pressure, such as the first pressure $P_1$, until the spray arm 200 resumed rotating and rotated to the second position 610 (FIG. 14).

Still referring to FIG. 15, a period T of the time-varying pressure signal 710 may correspond to one revolution of the spray arm 200. More specifically, the period T of the time-varying pressure signal 710 includes one pulse of the plurality of pulses 720. In addition, a frequency f of the time-varying pressure signal 710 may be equal to the inverse of the period T. More specifically, the frequency f of the time-varying pressure signal 710 may indicate a frequency with which the pressure differential $\Delta P$ occurs due to rotation of the spray arm 200 between the first and second position 600, 610 (FIGS. 13 and 14). It should be appreciated that the controller 137 (FIG. 2) may be configured to determine a rotational speed of the spray 200 of FIG. 12 in substantially the same manner as discussed above with reference to the spray arm 200 of FIG. 4.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwasher appliance defining a lateral direction, a transverse direction, and a vertical direction, the lateral, transverse, and directions mutually perpendicular to one another, the dishwasher appliance comprising:

a cabinet defining a wash chamber for receipt of articles for washing;

a spray arm disposed within the wash chamber, the spray arm defining an interior and an aperture providing selective fluid communication between the interior and the wash chamber;

a valve positioned within the interior of the spray arm;

a sensor operable to detect a pressure of a fluid flowing from a pump of the dishwasher appliance to the interior of the spray arm; and a controller communicatively coupled to the sensor, the controller configured to determine a rotational speed of the spray arm based, at least in part, on the detected pressure of the fluid, wherein the spray arm is rotatable between a first position wherein the valve allows fluid communication between the interior and the wash chamber through the aperture, and a second position wherein the valve obstructs fluid communication between the interior and the wash chamber through the aperture.

2. The dishwasher appliance of claim 1, wherein the valve includes a first support and a second support, and wherein the first support and the second support each include a blocking member.

3. The dishwasher appliance of claim 2, wherein the aperture is a plurality of apertures comprising a first aperture and a second aperture, and wherein the blocking member of the first support obstructs fluid communication between the interior and the wash chamber through the first aperture when the spray arm is in the second position.

4. The dishwasher appliance of claim 3, wherein the blocking member of the second support obstructs fluid communication between the interior and the wash chamber through the second aperture when the spray arm is in the second position.

5. The dishwasher appliance of claim 4, wherein the first aperture and the second aperture each define a circular cross-section, and wherein a maximum diameter of the first aperture is greater than a maximum diameter of the second aperture.

6. The dishwasher appliance of claim 5, wherein the controller is configured to determine a rotational speed of the spray arm based on a frequency with which a pressure differential occurs due to rotation of the spray arm between the first and second positions.

7. The dishwasher appliance of claim 6, wherein the controller is configured to generate an alarm when the rotational speed of the spray arm is less than or equal to a predetermined value.

8. The dishwasher appliance of claim 4, wherein the sensor detects a first pressure when the spray arm is in the first position, and a second pressure when the spray arm is in the second position, and wherein the first pressure is different than the second pressure.

9. The dishwasher appliance of claim 3, wherein the spray arm defines a pair of concentric walls extending into the interior, and wherein the first and second apertures are each positioned between the pair of concentric walls.

10. A dishwasher appliance comprising:

a cabinet defining a wash chamber for receipt of articles for washing;

a spray arm disposed within the wash chamber, the spray arm defining an interior and an aperture providing selective fluid communication between the interior and the wash chamber; and a valve positioned within the interior of the spray arm;

a sensor operable to detect a pressure of a fluid flowing from a pump of the dishwasher appliance to the interior of the spray arm, the sensor operable to detect a first pressure when the spray arm is in a first position in which the valve allows fluid communication between the interior and the wash chamber through the aperture, the sensor operable to detect a second pressure when the spray arm is in a second position in which the valve obstructs fluid communication between the interior and the wash chamber through the aperture, the second pressure being different than the first pressure; and a controller communicatively coupled to the sensor, the controller configured to determine a rotational speed of the spray arm based on a frequency with which a pressure differential occurs due to rotation of the spray arm between the first position and the second position.

11. The dishwasher appliance of claim 10, wherein the controller is configured to generate an alarm when the rotational speed of the spray arm is less than or equal to a predetermined value.

12. The dishwasher appliance of claim 11, wherein the alarm comprises a notification presented on a display of a user interface panel of the dishwasher appliance.

13. The dishwasher appliance of claim 10, wherein the valve includes a support having a blocking member.

14. The dishwasher appliance of claim 13, wherein the spray arm defines a pair of concentric walls extending into the interior, and wherein the aperture is positioned between the pair of concentric walls.

15. The dishwasher appliance of claim 14, wherein the blocking member is positioned between the pair of concentric walls, and wherein the blocking member obstructs fluid communication between the interior and the wash chamber through the aperture when the spray arm is in the second position.

16. The dishwasher appliance of claim 15, wherein the aperture is a plurality of apertures comprising a first aperture and a second aperture, and wherein the first and second apertures are each positioned between the pair of concentric walls.

17. The dishwasher appliance of claim 16, wherein the first and second apertures each define a circular cross-section, and wherein a maximum diameter of the first aperture is different than a maximum diameter of the second aperture.

* * * * *